US006408996B1

(12) United States Patent
Lin

(10) Patent No.: US 6,408,996 B1
(45) Date of Patent: Jun. 25, 2002

(54) BOTTOM PLATE ASSEMBLY FOR WHEELED LUGGAGE

(75) Inventor: Jer Hong Lin, Taipei (TW)

(73) Assignee: Chaw Khong Technology Co., Ltd. (TW)

( * ) Notice: Subject to any disclaimer, the term of this patent is extended or adjusted under 35 U.S.C. 154(b) by 0 days.

(21) Appl. No.: 09/661,951

(22) Filed: Sep. 14, 2000

(30) Foreign Application Priority Data

Jan. 25, 2000 (TW) ..... 089201262

(51) Int. Cl.[7] ..... A45C 5/00
(52) U.S. Cl. ..... 190/18 R; 190/115
(58) Field of Search ..... 190/18 A, 18 R, 190/115; 280/47.17, 645, 38

(56) References Cited

U.S. PATENT DOCUMENTS 2,132,316 A * 10/1938 Newton ..... 190/18 R X
5,295,565 A * 3/1994 Latshaw ..... 190/18 A
5,431,262 A * 7/1995 Rekuc et al. ..... 190/18 A
5,482,147 A * 1/1996 Wang ..... 190/18 A X
5,524,737 A * 6/1996 Wang ..... 190/18 A
5,524,920 A * 6/1996 Tsai ..... 190/18 A X
5,918,710 A * 7/1999 Sher ..... 190/18 A
6,062,356 A * 5/2000 Nykoluk ..... 190/18 R
6,131,713 A * 10/2000 Sher ..... 190/18 A X
6,176,357 B1 * 1/2001 Kuo ..... 190/18 A

FOREIGN PATENT DOCUMENTS

TW 331096 5/1998 ..... A45C/5/14
TW 341075 9/1998 ..... A45C/5/14

* cited by examiner

*Primary Examiner*—Lee Young
*Assistant Examiner*—Tri Mai
(74) *Attorney, Agent, or Firm*—Ware, Fressola, Van Der Sluys & Adolphson, LLP

(57) ABSTRACT

A bottom plate assembly for wheeled luggage is disclosed. The assembly comprises a support member and a foot sub-assembly both capable of being manufactured from a number of varied molds. With this, a variety of bottom plate assemblies are effected for assembling with a corresponding luggage of conformed size. The number of molds for manufacturing a variety of luggage are much decreased, resulting in a reduction in the manufacturing and maintenance costs.

3 Claims, 8 Drawing Sheets

BOTTOM PLATE ASSEMBLY FOR WHEELED LUGGAGE

BACKGROUND OF THE INVENTION

1. Field of the Invention

The present invention relates to luggage and more particularly to a bottom plate assembly for wheeled luggage.

2. Description of Related Art

Conventionally, wheeled luggage comprises a plastic frame and a canopy enclosed thereon. Further, the plastic frame, wheel assembly, and handle assembly are closely related in the configuration. As such, the construction of a bottom plate assembly is very important to the quality and manufacturing cost of luggage.

A number of designs have been developed to improve the bottom plate assembly of luggage. For example, in Taiwanese Patent Publication Nos. 341,075, entitled "Stable Bottom Plate Assembly for Wheeled Luggage" and 331,096, entitled "Improved Bottom Plate Assembly for Wheeled Luggage", both are simply constructed and easy to assemble. But these are unsatisfactory for the purpose for which the present invention is concerned because the wheel bracket, bottom plate assembly, and frame are integrally formed. Currently, there is a variety of luggage commercially available, with each manufactured from a unique mold. In view of the foregoing, the cost of preparing molds is high. Further, the storage and management of such a variety of molds is burdensome to manufacturers.

SUMMARY OF THE INVENTION

It is an object of the present invention to provide a detachable bottom plate assembly for wheeled luggage with simplified components and easy assembly features.

It is another object of the present invention to provide a bottom plate assembly for wheeled luggage, wherein the bottom plate assembly comprises a support member and a foot sub-assembly both capable of being manufactured from a number of varied molds. As a result, a variety of bottom plate assemblies may be attached to corresponding luggage of conformed size. The drawback of conventionally preparing a variety of molds is eliminated, resulting in a reduction in manufacturing and maintenance costs.

To achieve the above and other objects, the present invention provides a bottom plate assembly for wheeled luggage comprised of a support member having a Y-shaped plate and a foot sub-assembly having two feet and a bottom handle, wherein one pair of yoke members, extended from both ends of the Y-shaped plate, can be replaced by another pair of yoke members of a different size. Thus, a variety of luggage with different widths can be manufactured by simply replacing the original support member mold with another support member mold of a different size. Similarly, a variety of luggage with different lengths can be manufactured by simply replacing the original foot mold with another foot mold of different size.

The above and other objects, features and advantages of the present invention will become apparent from the following detailed description taken with the accompanying drawings.

DETAILED DESCRIPTION OF THE PREFERRED EMBODIMENTS

Figure 1A:
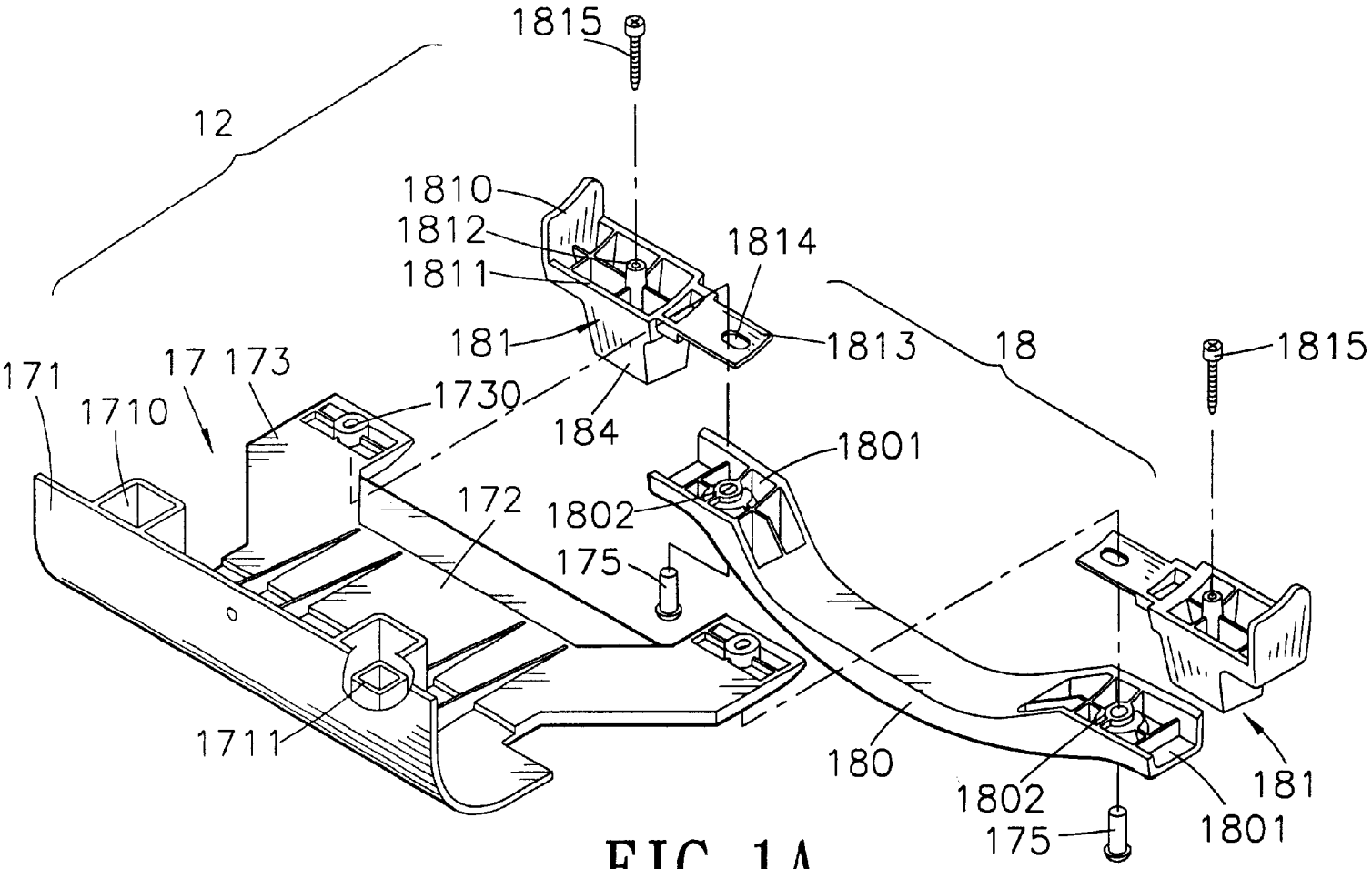
FIG. 1A is an exploded perspective view of a bottom plate assembly for wheeled luggage in accordance with the present invention, wherein the bottom plate assembly has two short feet.
Figure 3:
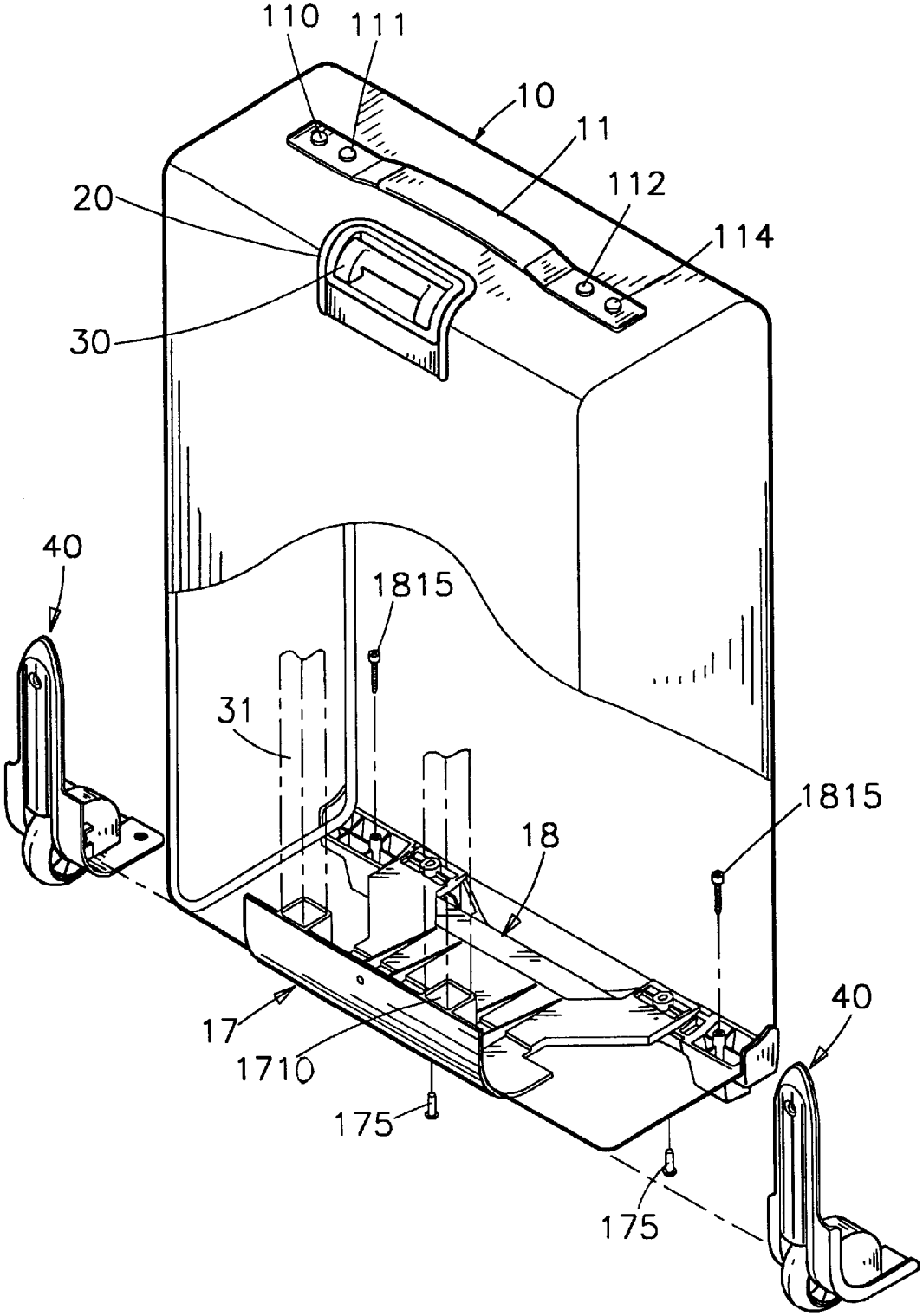
FIG. 3 is a schematic view showing the assembled bottom plate assembly for wheeled luggage of FIG. 1.
Figure 4:
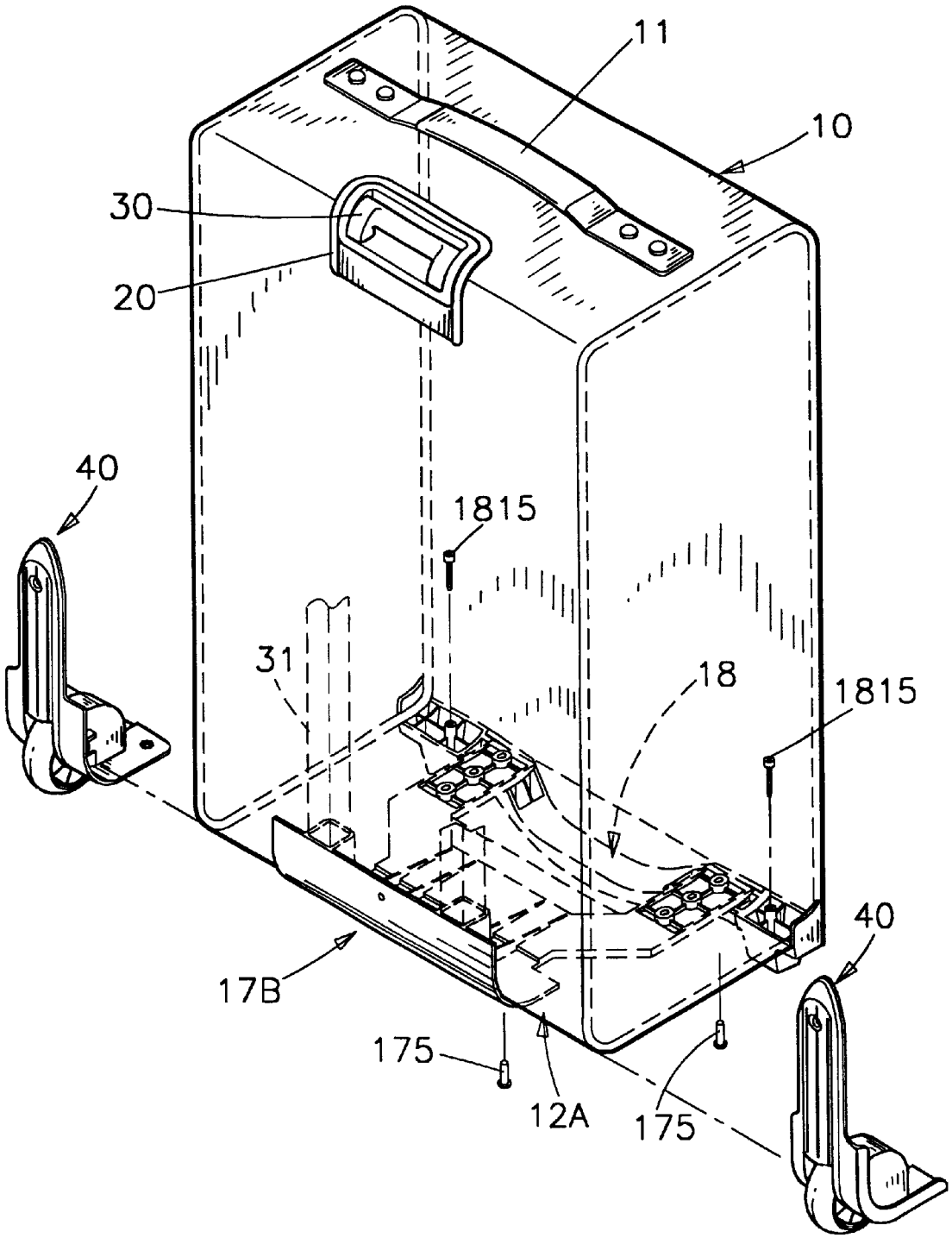
FIG. 4 is a schematic view showing the assembled bottom plate assembly for wheeled luggage of FIG. 2.

FIGS. 1A and 3 show a bottom plate assembly 12 for wheeled luggage constructed in accordance with the invention. The bottom plate assembly comprises a support member 17 and a foot sub-assembly 18 being releasably secured to the support member 17 by fasteners 1815 and 175, wherein the support member 17 includes an arcuate flange 171, two spaced sockets 1710 provided on the vertical portion of the flange 171 for receiving support tubes 31, a Y-shaped plate 172, one pair of yoke members 173 extended outward from both ends of the Y-shaped plate 172, and a tube member 1730 on either yoke member 173; and the foot sub-assembly 18 includes a bottom handle 180 having two attachment portions 1801 at both ends and a tube member 1802 on either attachment portion 1801, and two feet 181, each having a recessed portion 1811, a tube member 1812, an inward extended connection portion 1813 having a hole 1814, and an L-shaped plate 1810 for securing to the bottom of the wheeled luggage. The bottom handle 180 is secured to a foot 181 by employing a fastener 175 to penetrate through the tube member 1802 of the attachment portion 1801 and the hole 1814 of the connection portion 1813 in order to fasten them to the tube member 1730 together.

Figure 1B:
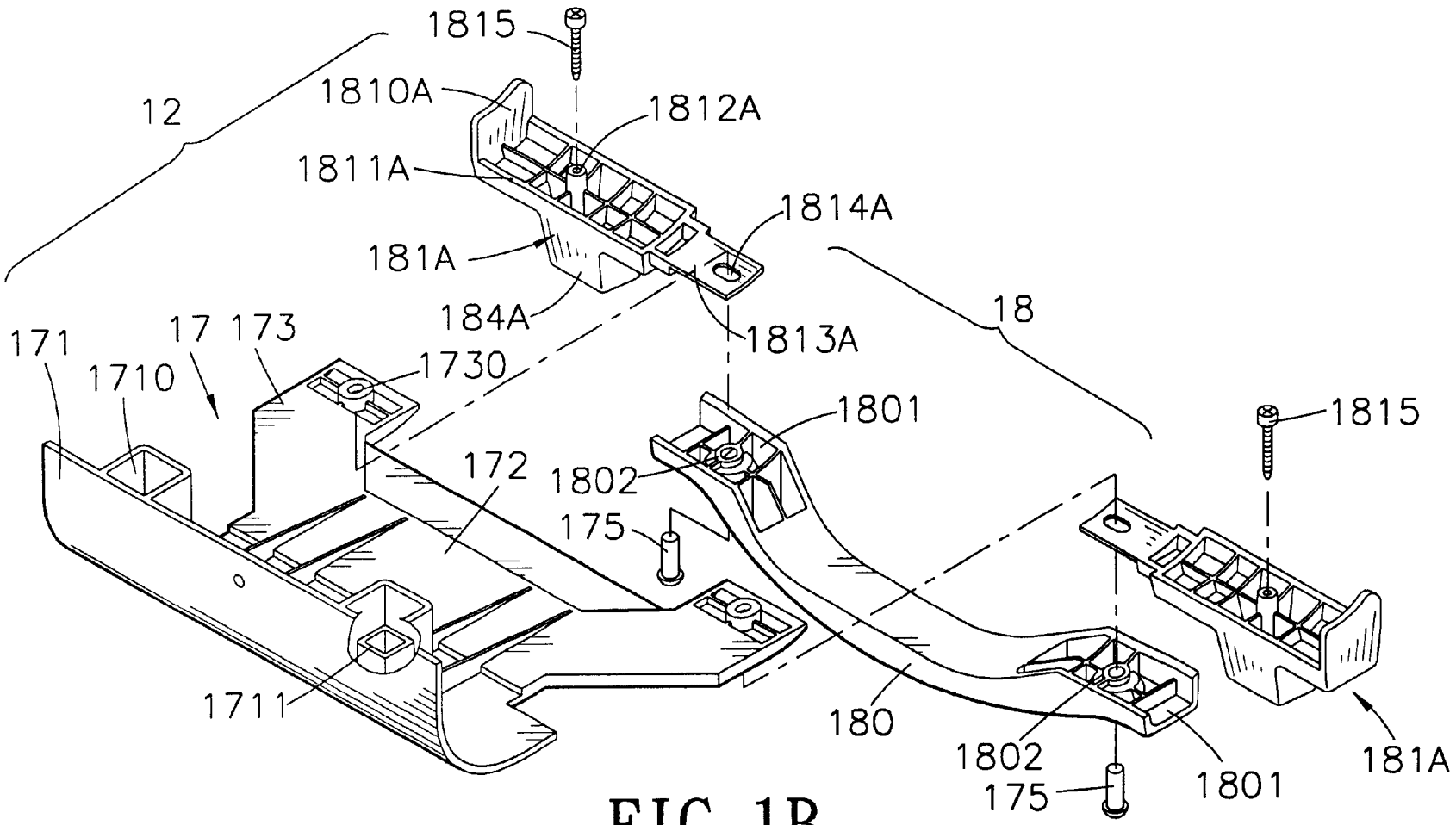
FIG. 1B is an exploded perspective view of a bottom plate assembly for wheeled luggage in accordance with the present invention, wherein the bottom plate assembly has two medium feet.
Figure 1C:
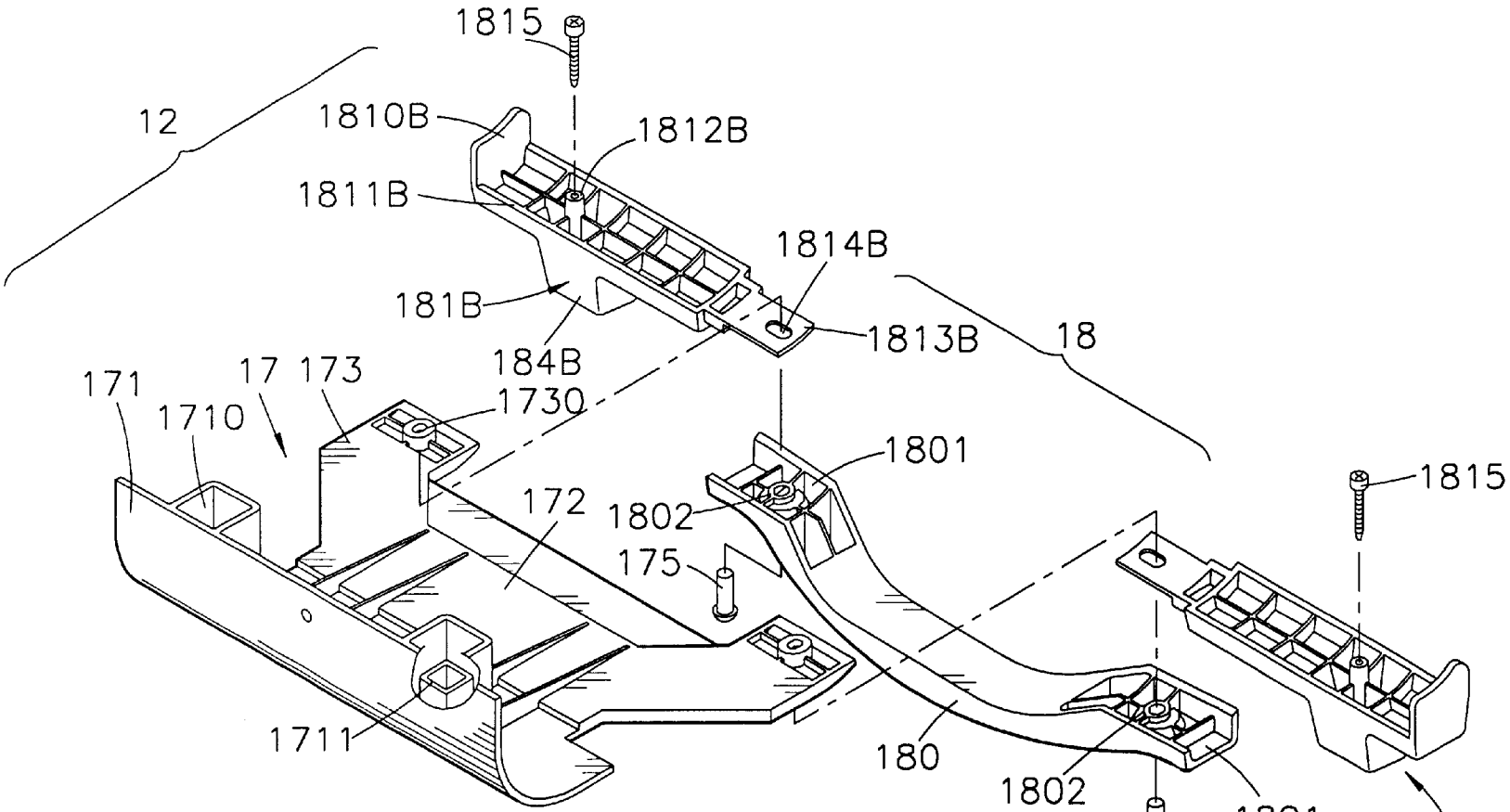
FIG. 1C is an exploded perspective view of a bottom plate assembly for wheeled luggage in accordance with the present invention, wherein the bottom plate assembly has two long feet.
Figure 2A:
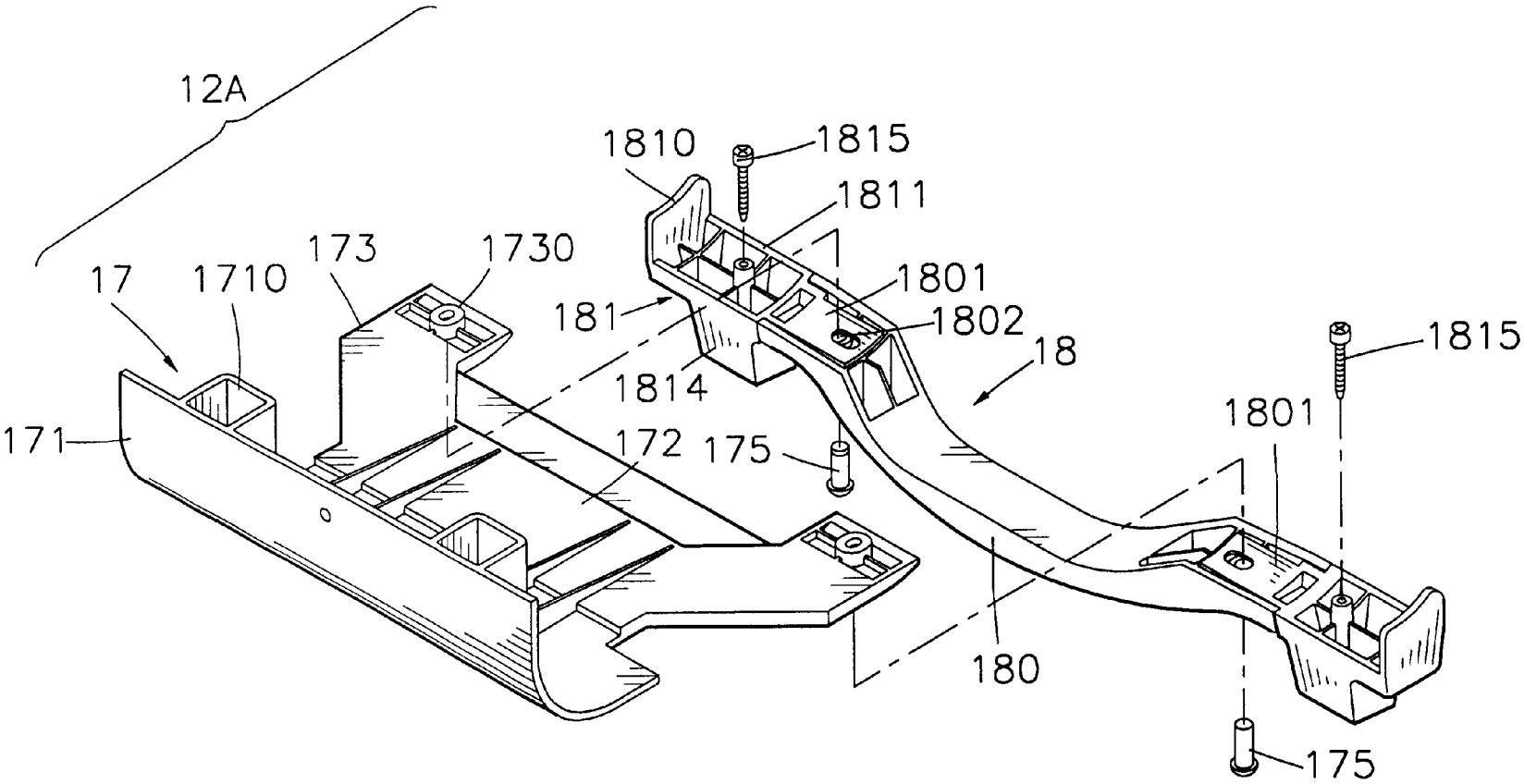
FIG. 2A is an exploded perspective view of a bottom plate assembly for wheeled luggage in accordance with the present invention, wherein the bottom plate assembly has two short yoke members.
Figure 2B:
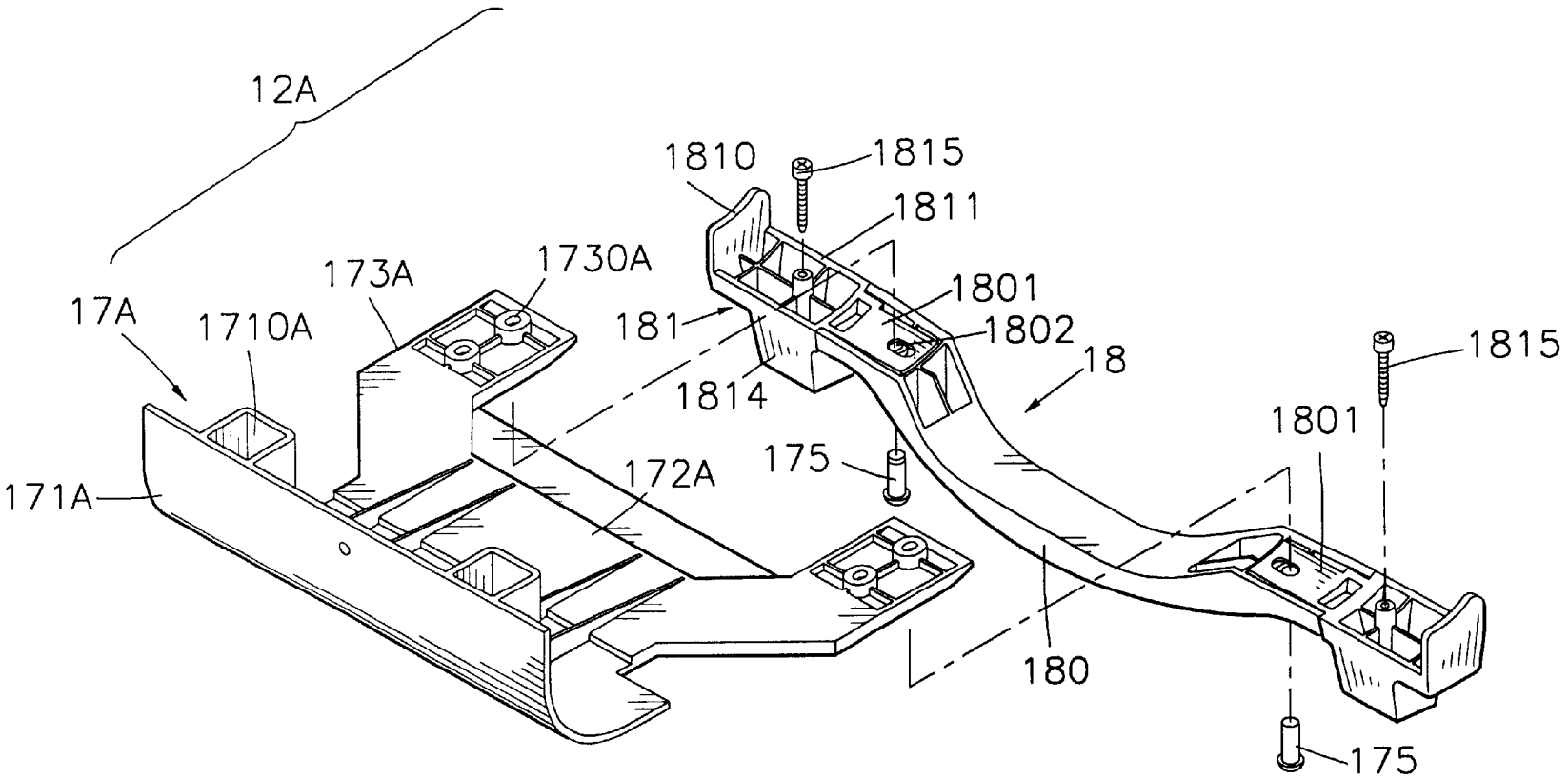
FIG. 2B is an exploded perspective view of a bottom plate assembly for wheeled luggage in accordance with the present invention, wherein the bottom plate assembly has two medium yoke members.
Figure 2C:
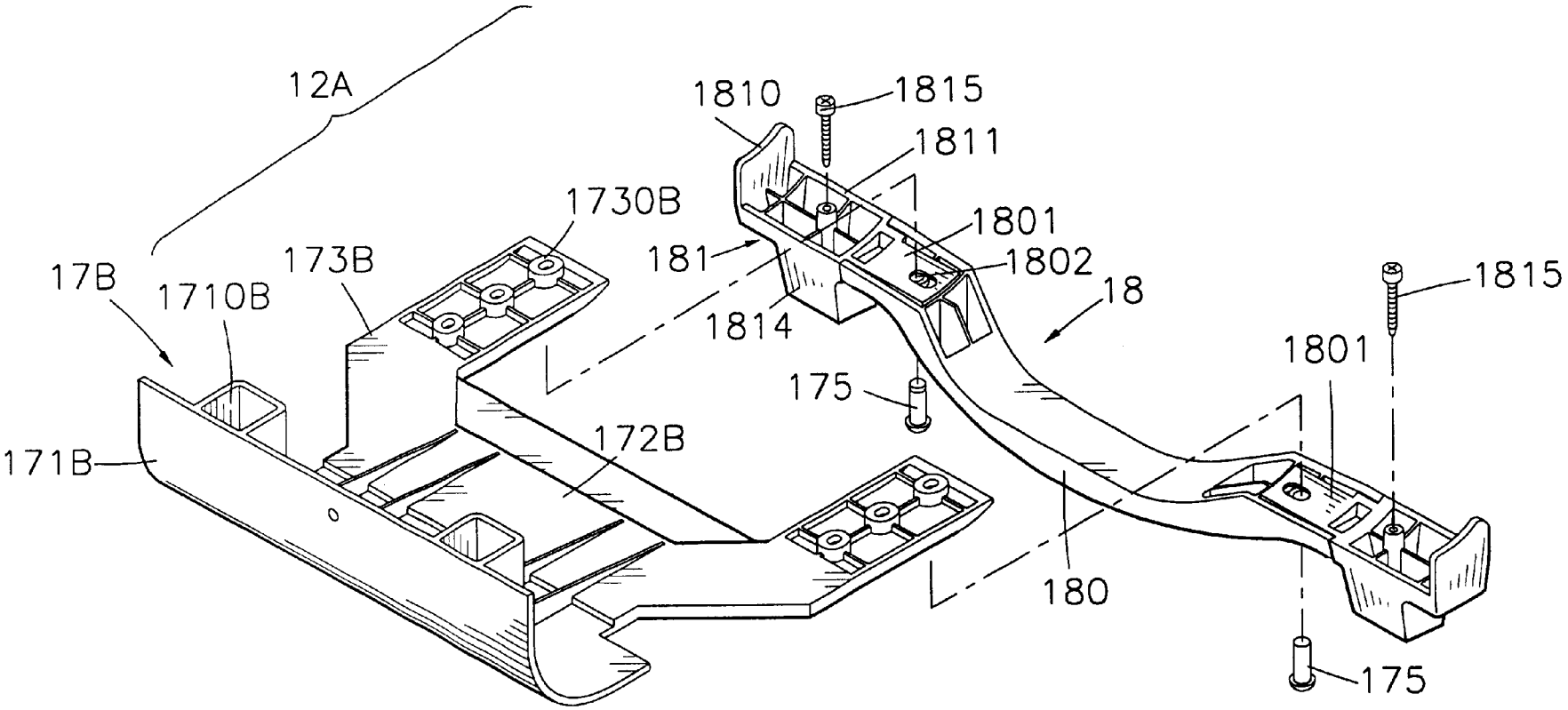
FIG. 2C is an exploded perspective view of a bottom plate assembly for wheeled luggage in accordance with the present invention, wherein the bottom plate assembly has two long yoke members.

Note that foot sub-assembly 18 may be configured by a bottom handle 180 and one medium foot 181A (FIG. 1B), or one long foot 181B (FIG. 1C), instead of the short foot 181, as shown in FIG. 1A. Thus, a variety of luggages with different lengths can be manufactured by simply replacing the original foot 181 mold with another foot 181 mold of a different size.

Referring to FIG. 3 specifically, the luggage of this embodiment comprises a main body 10, a top handle 11 secured to the top of the main body 10 by fasteners 110–114, a bezel 20 on the junction of the top and rear of the main body 10, a retractable handle assembly 30 in the bezel 20 having two support tubes 31 secured to sockets 1710 of the support member 17, and two wheel assemblies 40 provided on the bottom with support member 17 located therebetween. Note that the main body 10 may be of a hard-side (e.g., molded thermoplastic) or soft-side (e.g., fabric) construction, thus providing options for manufacturers.

FIGS. 2A, 2B, 2C and 4 show the second embodiment of the invention. This embodiment has substantially the same configuration as the first embodiment, except for the following. The two yoke members 173 of the support member 17 may be configured by one of short, medium, or long yoke members—173 (FIG. 2A), 173A (FIG. 2B), and 173B (FIG. 2C), respectively. Thus, a variety of luggage of different widths can be manufactured by simply replacing the original support member 17 mold with another support member 17 mold of a different size.

It is appreciated by those skilled in the art that other configurations are possible. For example, the flange 171, sockets 1710, tube members 1811, and bottom handle 180 may be modified. Further, the support member 17 and foot sub-assembly 18 may be integrally formed for varying the length and/or width of the luggage. Also, the L-shaped plate 1810 may be omitted.

Thus, the present invention has been disclosed with respect to the preferred embodiments thereof. It will be understood by those skilled in the art that the foregoing and various other changes, omissions and deviations in the form and detail thereof may be made without departing from the spirit and scope of this invention.

What is claimed is:

1. A bottom plate assembly/luggage combination (12) of wheeled luggage with a bottom having a width defined by a rear bottom edge and a front bottom edge, and a length defined by two front bottom corners on opposite sides of the front bottom edge, the wheeled luggage including a handle assembly (30) on a top section of the wheeled luggage and at least two wheels mounted on the rear bottom edge, said bottom plate assembly/luggage combination comprising:

a support member (17) for supporting at least a portion of the bottom of the wheeled luggage;

a foot sub-assembly (18), releasably secured to the support member (17), and two foot members (181) positioned on opposite ends of the foot sub-assembly (18) for securing the foot sub-assembly (18) to the bottom near the front bottom edge of the wheeled luggage, wherein the support member (17) includes:

a flange (171) positioned on the rear edge of the wheeled luggage between the two wheels;

two spaced sockets (1710) provided on the flange (171) substantially facing the bottom for receiving the handle assembly (30);

a support plate (172) extended from the flange (171) and positioned at the bottom of the wheeled luggage; and one pair of yoke members (173) extended outward from opposite ends of the support plate (172) for engaging the support plate (172) with the foot sub-assembly (18), wherein each of the yoke members (173) has a length, together with the foot sub-assembly (18), to suit the width of the bottom of the wheeled luggage.

2. A bottom plate assembly/luggage combination (12) of wheeled luggage with a bottom having a width defined by a rear bottom edge and a front bottom edge, and a length defined by two front bottom corners on opposite sides of the front bottom edge, the wheeled luggage including a handle assembly (30) on a top section of the wheeled luggage and at least two wheels mounted on the rear bottom edge, said bottom plate assembly/luggage combination comprising:

a support member (17) for supporting at least a portion of the bottom of the wheeled luggage;

a foot sub-assembly (18), releasably secured to the support member (17), and two foot members (181) positioned on opposite ends of the foot sub-assembly (18) for securing the foot sub-assembly (18) to the bottom near the front bottom edge of the wheeled luggage, wherein the foot sub-assembly (18) includes a middle section disposed between the front bottom edge and the rear bottom edge and having an arcuate section spaced from the bottom of the wheeled luggage so that the middle section can be used as a bottom handle.

3. A bottom plate assembly/luggage combination (12) of wheeled luggage with a bottom having a width defined by a rear bottom edge and a front bottom edge, and a length defined by two front bottom corners on opposite sides of the front bottom edge, the wheeled luggage including a handle assembly (30) on a top section of the wheeled luggage and at least two wheels mounted on the rear bottom edge, said bottom plate assembly/luggage combination comprising:

a support member (17) for supporting at least a portion of the bottom of the wheeled luggage;

a foot sub-assembly (18), releasably secured to the support member (17), and two foot members (181) positioned on opposite ends of the foot sub-assembly (18) for securing the foot sub-assembly (18) to the bottom near the front bottom edge of the wheeled luggage, wherein each of two feet (181) has an L-shaped portion (1810) fitting to the respective front bottom corner, and each of the two foot members (181) has a length to suit the length of the bottom of the wheeled luggage such that the distance between the two L-shaped portions is substantially equal to length of the bottom of wheeled luggage.

* * * * *